US005110302A

United States Patent [19]

Kobler

[11] Patent Number: 5,110,302

[45] Date of Patent: May 5, 1992

[54] LATCHING MEANS FOR ELECTRICAL CONNECTORS

[75] Inventor: Robert J. Kobler, Harrisburg, Pa.

[73] Assignee: AMP Incorporated, Harrisburg, Pa.

[21] Appl. No.: 325,077

[22] Filed: Mar. 16, 1989

Related U.S. Application Data

[63] Continuation of Ser. No. 171,200, Mar. 15, 1988, abandoned, which is a continuation of Ser. No. 896,307, Aug. 12, 1986, abandoned, which is a continuation of Ser. No. 735,417, May 17, 1985, abandoned.

[51] Int. Cl.[5] ..... H01R 13/627

[52] U.S. Cl. ..... 439/357

[58] Field of Search ..... 439/350-358, 439/298, 310, 586, 592, 594, 596

[56] References Cited

U.S. PATENT DOCUMENTS

| | | | |
|---|---|---|---|
| 3,937,545 | 2/1976 | Cairns et al. | 339/60 R |
| 4,017,138 | 4/1977 | Evans | 339/75 MP |
| 4,310,211 | 1/1982 | Bunnell et al. | 339/91 R |
| 4,376,563 | 3/1983 | Margrave et al. | 439/358 |
| 4,486,062 | 12/1984 | Kasugai | 339/94 M |
| 4,586,773 | 5/1986 | Lothmann et al. | 339/91 R |

FOREIGN PATENT DOCUMENTS

| | | | |
|---|---|---|---|
| 0091770 | 10/1983 | European Pat. Off. | 339/94 M |
| 2013047 | 8/1979 | United Kingdom | 339/60 R |
| 2130445 | 5/1984 | United Kingdom | 339/91 R |

*Primary Examiner*—David Pirlot
*Attorney, Agent, or Firm*—Anton P. Ness

[57] ABSTRACT

A latching system such as for matable first and second electrical connectors having matable pin and socket contact terminals comprises a pair of opposing latching arms each extending forwardly from a joint on opposing sides of the second electrical connector in cantilever fashion, to latchingly engage behind a pair of corresponding latching projections on opposing sides of the first electrical connector when the connectors are fully mated. The latching projections are high and abrupt and relatively sharp having steep forward and rearward surfaces generating substantial resistance to latching during mating. When the latching sections of the latching arms reach the sharp outer tips of the latching projections, the resistance to latching suddenly ceases and the latching sections immediately latch behind the respective projections without hanging up on top thereof, assuring full mating and providing a snap action which provides an audible signal. The latching system also provides resistance to delatching during unmating of a similar substantial level to the resistance to latching.

11 Claims, 5 Drawing Sheets

12
14
110
108
102
104
100
106
24
26
56
22
70
72
20
16
74
82
32
38
36
34
84
80
44
90
86
88
54
62
60
64
52
48
42
40

LATCHING MEANS FOR ELECTRICAL CONNECTORS

This application is a continuation of application Ser. No. 07/171,200 filed Mar. 15, 1988, now abandoned, in turn, a continuation of application Ser. No. 896,307 filed Aug. 12, 1986, now abandoned, in turn, a continuation of application Ser. No. 735,417 filed May 17, 1985 now abandoned.

FIELD OF THE INVENTION

The present invention relates to latching means and more particularly to latching means for electrical connectors.

BACKGROUND OF THE INVENTION

Various latching means are known to latch together housings of opposing electrical connectors being mated to electrically engage mating pairs of contact terminals secured therewithin. One such latching means is known which comprises a pair of long latching cantilever arms extending forwardly along the plug portion of one housing spaced outwardly therefrom to receive a hood portion between the latching arms and the plug portion, and latch over a corresponding pair of latching projections extending radially outwardly from the hood portion. The latching projections have a relatively steep forward surface and a relatively long gradually declining rearward section ending in a rearwardly facing latching surface behind which a lateral latching section of the latching arm will eventually be latchingly secured.

It is desirable to provide a latching means which latchingly secures opposing connectors together. It is also desirable to provide a latching means which provides a clear indication that the housings are in a fully mated condition. It is further desirable to provide a latching means which can minimize the possibility of incomplete latching and therefore the possibility of incomplete mating caused by the possibility of the latching arm dwelling atop a portion of the latching projection.

SUMMARY OF THE INVENTION

The present invention comprises one or more, preferably a pair of relatively high abrupt latching projections extending outwardly from opposing sides of a connector housing, behind which will latch lateral sections of free ends of corresponding latching arms on a mating connector housing. The latching projections each have a steep forwardly facing surface slightly angled for the latching arm to be deflected radially outwardly, a sharp but preferably rounded outermost tip portion having a very small axial dimension, and a steep rearwardly facing latching surface behind which will latch the lateral section at the free end of a corresponding latching arm. The projections are high and steep enough when engaged by the latching arm, and the latching arms have enough spring strength, to provide substantial resistance to latching and to require substantial force added to the mating force already required to overcome the internal resistive forces of the mating contact terminals and a deformable annular sealing member, if one is being used. The abrupt nature of the projections in conjunction with axially short lateral sections on the latching arms, minimizes possible hang-up of the latching arms atop the projections. The latching arms snap against the housing, signalling full mating when their spring energy is suddenly released.

DETAILED DESCRIPTION OF THE PREFERRED EMBODIMENT

Figure 1:
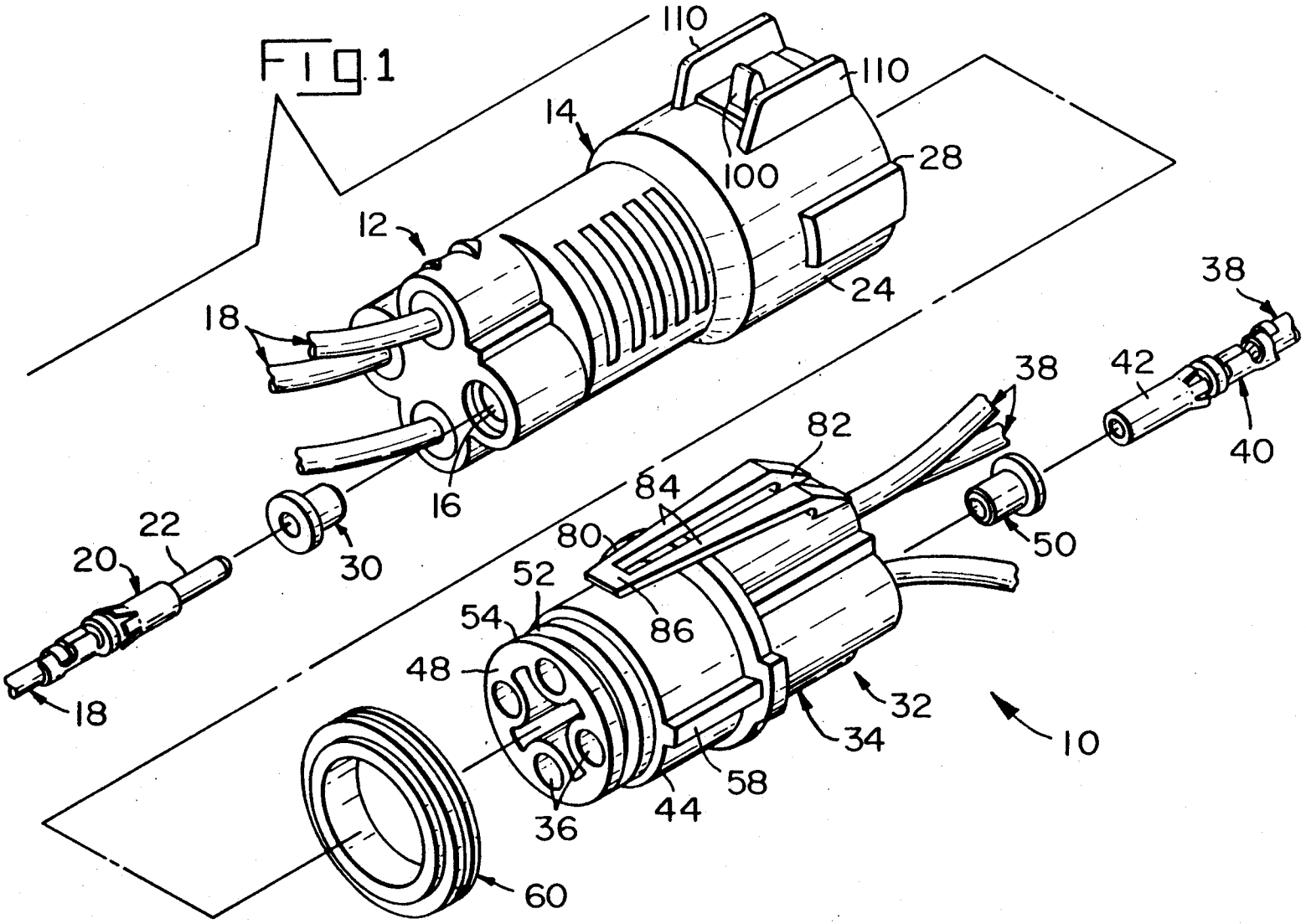
FIG. 1 is an exploded perspective view of a connector assembly using the latching means of the present invention.

FIG. 1 shows an electrical connector assembly 10 having multiterminal first connector 12 and second connector 32. First connector 12 has a first dielectric housing 14 having a plurality of terminal-receiving cavities 16 extending axially therethrough to receive conductors 18 having pin terminals 20 terminated on forward ends thereof. Pin terminals 20 have pin contact sections 22 which extend forwardly of the mating face of housing 14 within hood section 24 at the forward end of housing 14, protected by hood section 24 and spaced inwardly from front surface 28. Wire seals 30 are secured sealingly around conductors 18 and disposed in enlarged rearward sections of cavities 16 in housing 14. Second connector 32 has a second dielectric housing 34 having a plurality of cavities 36 to receive conductors 38 having socket terminals 40 on forward ends thereof. Socket terminals 40 have socket contact sections 42 which extend forwardly within forward portions of cavities 36 within plug section 44 comprising the forward end of housing 34. The forward portions of cavities 36 extend to front surface or mating face 48 of housing 34. Wire seals 50 are secured sealingly around conductors 38 in enlarged rearward sections of cavities 36 in housing 34. Plug section 44 of housing 34 will be disposed within hood section 24 of housing 14 when mated, and is dimensioned accordingly. Socket contact sections 42 will receive respective pin contact sections 22 therein when mated and be electrically engaged therewith under axially normal contact force to assure an appropriate electrical connection.

Plug section 44 has an annular groove 52 therearound spaced rearwardly from front surface 48. An annular sealing member 60 is to be disposed in groove 52 and has a portion which protrudes above the peripheral surface 54 of plug section 44 to sealingly engage and be deformed by an inner surface of hood section 24 of housing 14 when mated, forming a mositure-resistant seal therearound. Annular sealing member 60 is shown in greater detail in FIGS. 3A, 3B and 3C and is discussed in greater detail below. Keying ridges 58 extend longitudinally along peripheral surface 54 of plug section 44 rearwardly from groove 52 and annular sealing member 60, and will enter corresponding keying channels (not shown) along the inner surface of the forward portion of hood section 24 to polarize the connectors 12, 32 during mating.

Latching projections 100 extend outwardly from opposing sides of hood section 24 of first housing 14, spaced rearwardly from front surface 28 thereof. In FIG. 1, to either side of each projection and spaced therefrom is a high longitudinally extending rib 110 to protect projection 100. A corresponding pair of latching arms 80 are disposed on sides of second housing 34, joined integrally thereto at joints 82 remote from front surface 48 thereof. Extending forwardly along plug section 44 from joints 82 in cantilever fashion are a pair of side sections 84 substantially parallel to each other and to plug section 44. A single lateral latching section 86 is joined integrally to free ends of side sections 84 of latching arms 80, and will ride over a corresponding latching projection 100 during mating and latch therebehind.

Figure 2:
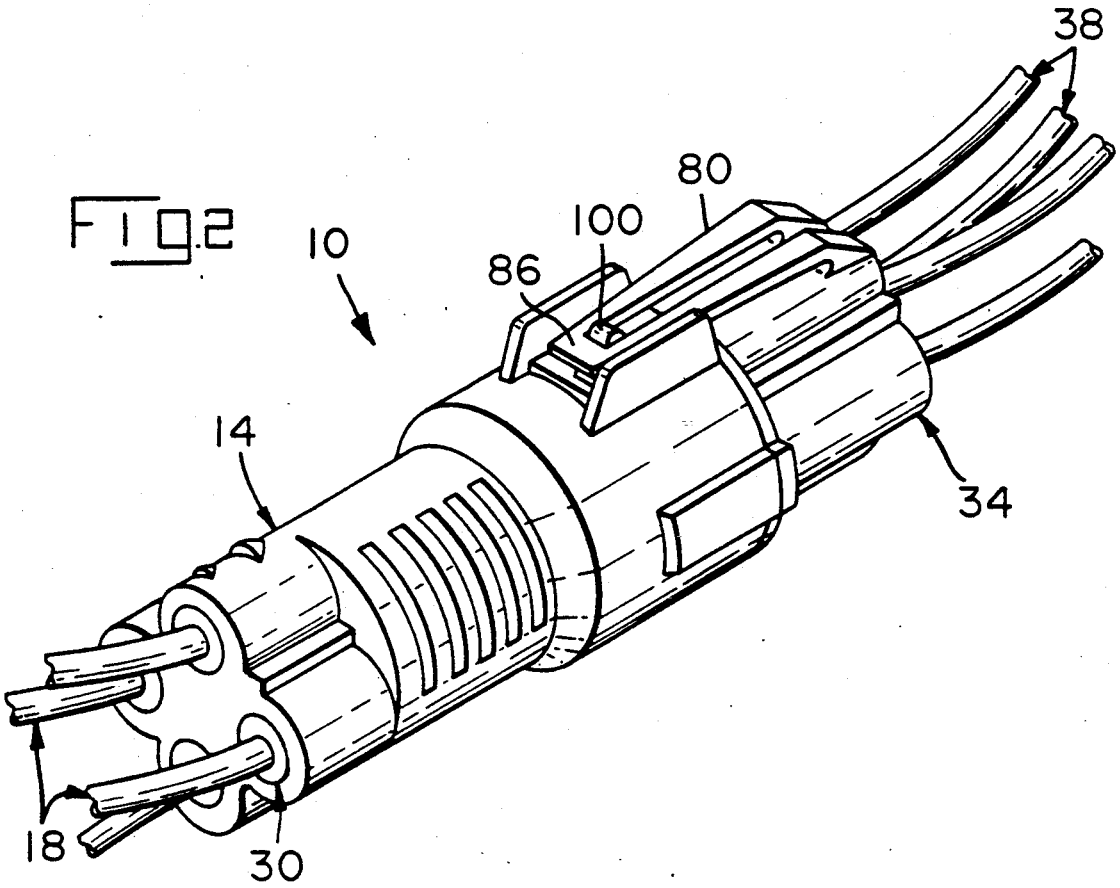
FIG. 2 is a perspective view of the assembly of FIG. 1 in assembled condition.

FIG. 2 illustrates the fully mated assembly 10 of connectors 12 and 32. Latching sections 86 are latched behind latching projections 100. The plug section of housing 34 is disposed within the hood section of housing 14, and the pin contact sections are disposed in the respective socket contact sections.

Figure 3A:
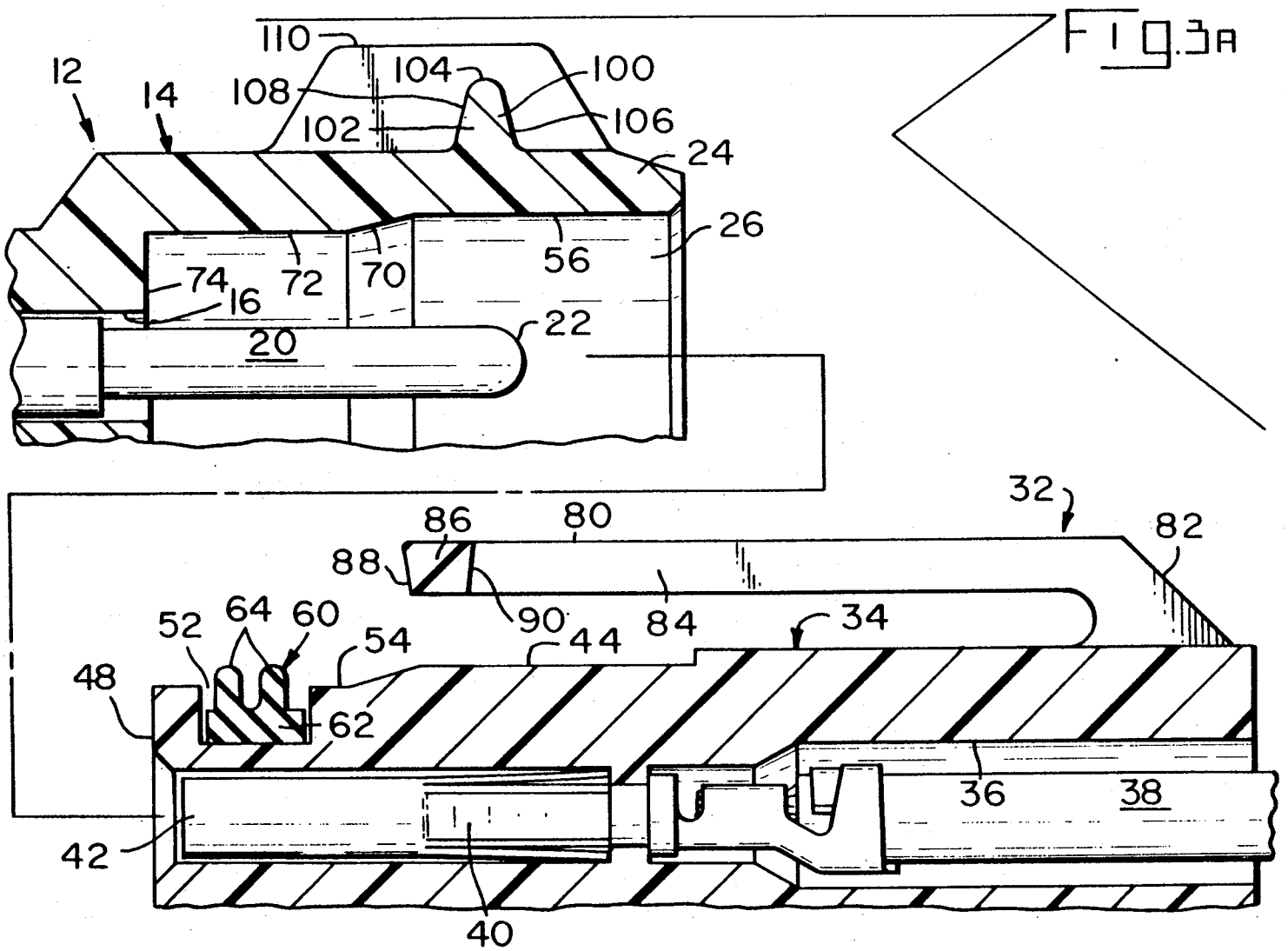
FIGS. 3A, 3B and 3C are part longitudinal section views of the latching and sealing areas of the assembly prior to, during, and following mating of the connectors.
Figure 3B:
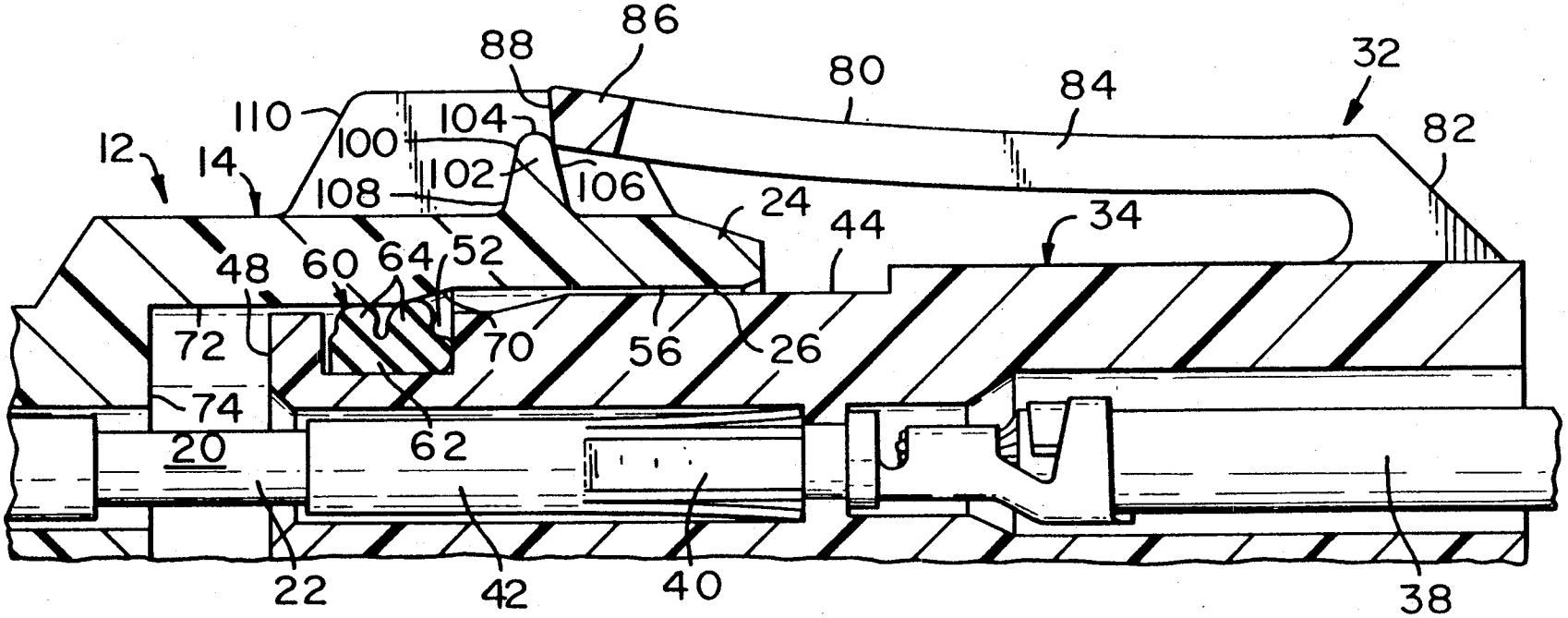
Figure 3C:
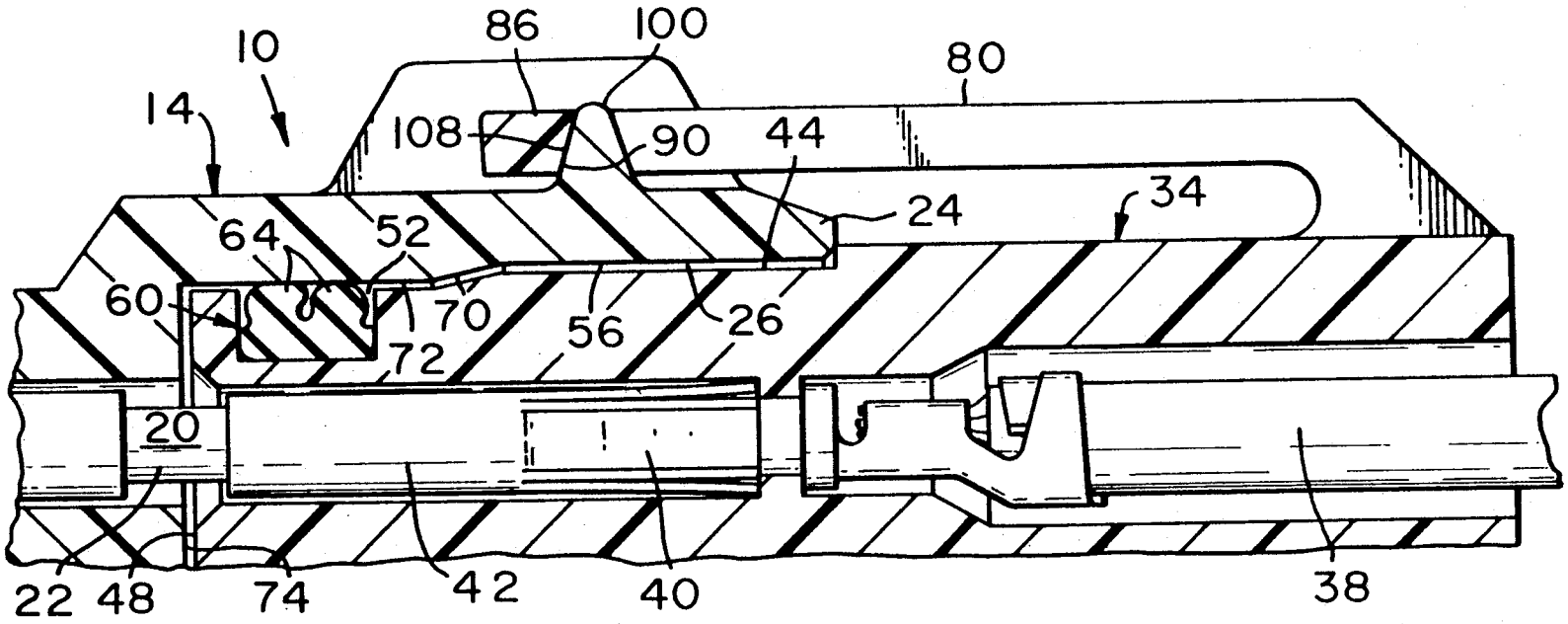

FIGS. 3A, 3B and 3C illustrate in detail a latching projection 100 and the sequence of latching of a latching arm 80 therewith. In FIG. 3A, latching projection 100 is shown with a protective rib 110 therebehind. Latching projection 100 comprises a high body portion 102 having a short axial dimension and having a relatively sharp outer tip 104 which is preferably radiused. Body portion 102 has a steep forwardly facing surface 106 and a steep rearwardly facing surface 108, each of which may be slightly tapered from the vertical to assist in latching, with outer tip 104 being tangential therewith.

Also in FIG. 3A, latching section 86 of latching arm 80 is shown in cross section and preferably has a forward projection-engaging surface 88 having a slight angle to assist in latching, and a rearward projection-engaging surface 90 having a slight angle to assist in delatching during unmating. Forward surface 88 will engage forward projection surface 106 during latching which will urge latching arm 80 radially outwardly.

Annular sealing member 60 is shown in cross section and may comprise a ring-like article such as a conventional O-ring of relatively incompressible elastomeric material. Annular sealing member 60 may optionally comprise a relatively incompressible elastomeric ring-like member having the cross section shown in FIG. 3A which consists of a body section 62 and two spaced parallel annular ribs 64 as disclosed more fully in U.S. Pat. No. 4,637,674. Such annular sealing member 60 may be comprised of a neoprene composition having inherent lubricity as disclosed more fully in U.S. Pat. No. 4,681,691.

In FIG. 3B, latching arm 80 has been deflected outwardly by latching projection 100 during the mating of connectors 12 and 32. Annular sealing member 60 has been deformed when ribs 64 have been engaged by forward inner surface portion 56 of hood section 24 of housing 14 and further deformed when they have been engaged by short tapered surface portion 70 and reduced diameter rearward inner surface portion 72. Annular ribs 64 have been deformed axially rearwardly by friction with surface portions 56, 70 and 72 and also radially inwardly, urging body section 62 to deform within groove 52.

Fully latched connector assembly 10 is shown in FIG. 3C with latching section 86 latched behind latching projection 100. Front surface 48 of plug section 44 is adjacent rearward surface 74 of large plug-receiving cavity 26 formed by hood section 24 of housing 14. Each pin contact section 22 is secured with a corresponding socket contact section 42 in mated electrical engagement therewith. Annular sealing member 60 is deformed within groove 52 against rearward inner surface portion 72 of hood section 24, forming a moisture-resistant seal to protect the electrical connections.

Each latching arm 80 is preferably substantially long for optimum cantilever spring action of desired spring strength, as seen in FIG. 3B. Each latching projection 100 is preferably high and abrupt, deliberately generating a substantial resistance to latching and requiring a substantial increase in the connector mating force over and above that needed to overcome the internal resistive forces of the mating contact terminals and the deforming sealing member. For example, a typical contact mating force of Size No. 16 pin and socket contacts would be about one pound per mating pair, or four pounds per four-terminal connection and a typical sealing force would be two pounds. A typical preferred axially applied latching force with such a connector would be about six pounds which would be of an order comparable to the total of the other forces and producing a total connector mating force of twelve pounds. It is preferred that the housings be made of unfilled thermoplastic polyester such as VALOX 357 resin (trademark of General Electric Company) to withstand the stresses placed on the latching arms and the latching projections.

Latching projection 100 is preferred to have a forward surface 106 having a slope of between 90 and 70 degrees from axial, and most preferably a slope of 80 degrees. Rearward surface 108 similarly is preferred having a slope of between 90 and 70 degrees from axial and most preferably 80 degrees. If rearward surface 108 is as steep as forward surface 106, a resistance to delatching during unmating is generated comparable to the resistance to latching generated during mating because of steep forward surface 106. The bases of the forward and rearward surfaces should be radiused to strengthen the joint area. The forward and rearward surfaces of latching sections 86 of latching arms 80 preferably should be parallel to the forward and rearward surfaces 106, 108 and have corresponding slopes of between 70 and 90 degrees and most preferably 80 degrees.

The top of forward surface 88 should have a small radius and not a sharp edge. Further preference is for lateral latching sections 86 of latching arms 80 to have only a small axial dimension. Such short latching sections 86 will cooperate with sharp outer tips 104 of latching projections 100 to practically eliminate the possibility of incomplete mating of a pair of connectors by minimizing the "dwell" length of a latching section 86 atop an outer tip 104. Because of the significant axial connector mating force now needed at a relative instant in time to mate the connectors, and the sudden relief from that portion of the resistive force generated by the latching arrangement of the present invention when latching section 86 rides over outer tip 104, the significant axial force still being applied by the person mating the connectors will result in the immediate assured latching of latching section 86 over projection 100 without further effort or attention of the person or inadvertent lessening of the application of force. The sudden release of the spring force built up in the latching arms 80 will also usually result in a snapping of latching arm against housing 24 and an audible signal and a tactile signal to the person mating the connectors that full mating has occurred. Protective ribs 110 will not only protect latching projections 100 when the connectors are in an unmated condition but will also minimize the possibility of a foreign object such as a stray wire catching under a latching arm 80. However, the structure of the latching arms and projections of the present invention would require a similar level of force (such as six pounds) to delatch and unmate the assembly.

Figure 4:
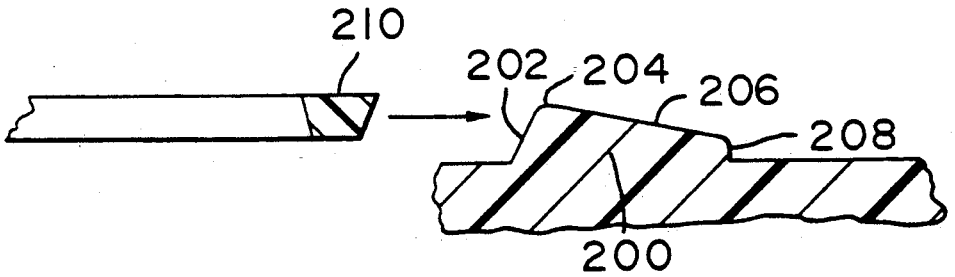
FIG. 4 PRIOR ART
FIG. 4 is an illustration of a prior art latching projection.
Figure 4A:
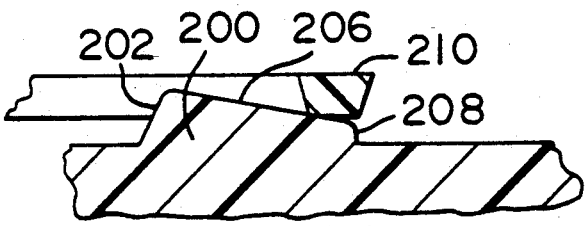
FIG. 4A PRIOR ART
FIG. 4A illustrates a latching arm atop the prior art latching projection of FIG. 4.

It is possible to use a metal spring clip with a latching arm for increased spring strength or stiffness over the integral plastic latching arm of the preferred embodiment. In such a system, forward surface 106 may be less steep and latching projection 100 may be less high but just as abrupt; and enough substantial resistance to latching would be generated which would assure full latching and mating when suddenly relieved of such resistance as the latching section rides over the latching projection:

In FIG. 4 is shown a latching projection 200 of the prior art. Projection 200 has a steep forward surface 202, a rounded tip 204 and a long gently tapered section 206 followed by a small rearward latching surface 208. It can be seen, as shown in FIG. 4A, that a latching arm 210 could tend to remain atop relatively gently tapered section 206 instead of completely latching behind latching surface 208. Careful visual inspection would have to be performed to assure that complete latching of the connectors having this prior art projection has occurred. Inadvertent unlatching and unmating could be seen to possibly occur because unmating force not as substantial as that needed with the present invention would be required by reason of this prior art latching means.

The latching means of the present invention could be used where positively assured mating is desired. It is believed to be usable wherever a substantial increase in the mating force is practically available and usable over and above that force already needed to overcome the interval resistive forces of the mating contact terminals having requisite normal contact forces. Such mating contacts could be blade and receptacle types, or hermaphroditic types, for instance. The latching means of the present invention is especially useful where a sealing member is desired to provide a sealing between the mating connectors. The present invention could also be used where it is desired to positively assume the proper seating of a strain relief member to the rearward end of a housing member of a sealed connector such as one similar to that disclosed in U.S. Pat. No. 4,713,021.

Other articles being assembled together which require positive assurance of axial mating or assembly could utilize the latching means of the present invention. Such articles could be cylindrical, or they could be hexagonal or rectangular in cross-section, for instance. Variations in the design, structure, number and placement of the latching projections and latching arms could be devised which are consistent with the spirit of the invention and within the scope of the claims. For example, one or three sets or more of latching arms and projections could foreseeably be used. The latching arms could extend forwardly beyond the front surface of a second article to latch behind a projection remote from the front surface of a first article. Also, a latching arm could be used having a latching slot to receive a projection, instead of comprising parallel side sections integrally joined at their free ends.

What is claimed is:

1. An improved electrical connector assembly comprising a first connector and a second connector axially matable therewith, wherein the first and second connectors have first and second housings respectively adapted to matably engage and having first and second terminals disposed in the first and second housings respectively and matable at first and second mating faces, the first and second connectors defining an inherent level of resistance to mating, and the first housing includes at least one latching projection extending outwardly from a respective side thereof at an axial location with respect to the first mating face thereof and the second housing has a resilient cantilever latching arm associated with each latching prejection and having a latching section on a free end thereof, each latching arm being secured to the second housing at a respective location along the side thereof and extending axially forwardly therefrom, each latching projection and latching section being adapted for the latching arm to be deflected outwardly against a selected latching arm spring strength during connector mating by riding over an associated latching projection and the latching section to latch therebehind when the first and second connectors are in fully mated relationship, and each latching section has forwardly and rearwardly facing projection-engaging surfaces, and each latching projection comprises a body section having an arm-engaging forward surface, a rearward surface and a radiused outer tip portion therebetween and tangential with the forward and rearward surfaces, the improvement comprising:

each said latching projection forward surface extending at an angle of between about 70° and 90° from axial and being steep and abrupt, and each said latching section forward surface extending at an angle of between 70° and 90°, with at least one thereof being less than 90°;

with the construction of each latching arm resulting in a spring strength such as to generate a substantial resistance to latching upon engagement with the associated latching prejection similar in amount to the inherent resistance to mating, whereby during initial mating movement the latching section of the latching arm initially engages and is stopped by the abrupt, steep latching projection whereafter no further axially together movement of the connectors can occur until the instantaneous application of increased axial mating force needed to overcome the resistance to latching suddenly encountered, and eacn said latching section having a short axial dimension between said forward and rearward surfaces thereof and said rearward surface thereof being steep, and each said latching projection rearward surface having a slope of between 70° and 90° engageable by a said steep rearward surface of a said latching section, to minimize resistance to resiling of a deflected said latching arm and latching of a said latching section therebehind, whereupon the latching section immediately rides over and latches behind the abrupt, steep latching projection.

2. An electrical connector assembly as set forth in claim 1 wherein said slope of said latching projection rearward surface is selected to be about equal to said slope of said forward surface thereof, thereby generating a resistance to delatching during unmating correspondingly about equal to said resistance to latching during mating and requiring application of a substantial axially applied force on said first and second electrical connectors to overcome said resistance to delatching during unmating.

3. An electrical connector assembly as set forth in claim 1 wherein said forward latching section surface is slightly angled inwardly to assist in engaging a respective said latching projection forward surface to initiate deflection of said latching section radially outwardly.

4. An electrical connector assembly as set forth in claim 1 wherein said rearward latching section surface is slightly angled inwardly to assist in engaging a respective said latching projection rearward surface to initiate deflection of said latching section radially outwardly during axial unmating of said first and second electrical connectors.

5. An electrical connector assembly as set forth in claim 1 wherein said second electrical connector has two opposing said latching arms and said first electrical connector has two opposing said latching projections.

6. An electrical connector assembly as set forth in claim 1 wherein each said latching section comprises a lateral section integrally joined to respective free ends of coextending side sections of each said latching arm.

7. An electrical connector assembly as set forth in claim 1 wherein each said latching arm is integrally joined to said second housing at said securing location.

8. An electrical connector assembly as set forth in claim 1 wherein one of said first and second housings includes a forward plug section and the other thereof includes a corresponding hood section adapted to receive said plug section thereinto, and said plug section has an annular sealing member disposed therearound which is deformable by said hood section to sealingly engage an inner surface portion of said hood section upon mating, said deforming contributing to said resistance to mating.

9. An electrical connector assembly as set forth in claim 8 wherein ones of said first and second terminals associated with said one of said first and second housings are socket terminals having sockets disposed within said plug section and the others of said first and second terminals are pin terminals having pin sections extending forwardly from said other of said first and second housings and within said hood section to electrically engage corresponding said sockets during mating.

10. An improved latching system for latching together axially matable multiterminal plug and receptacle electrical connectors of the type having an inherent resistance to mating, substantially contributed to by necessary deformation of an annular axially short sealing member about a forward plug section of a housing of the plug connector by an inside surface portion of a hood section of a housing of the receptacle connector at a selected location therealong for environmental sealing of the connector mating faces, the latching system comprising at least one resilient cantilever latching arm extending forwardly along an outer side of one of the connector housings and having a forward latching section which upon axial application of mating force to the connectors is adapted to be deflected outwardly against a selected latching arm spring strength to ride over a corresponding at least one latching projection along an outer side of the other of the connector housings to latch therebehind with each latching projection having a forward and rearward surfaces converging at a radiused outer tip, the improvement comprising:

each said latching section having a steep forwardly facing projection-engaging surface, each said latching projection having a selected height and a steep arm-engaging forward surface, with the construction of each latching arm resulting in a spring strength such as to generate a substantial resistance to latching upon engagement with the associated latching projection similar in amount to the inherent resistance to mating, whereby during initial mating movement the latching section of the latching arm initially engages and is stopped by the abrupt, steep latching projection whereafter no further axially together movement of the connectors can occur until the instantaneous application of increased axial mating force needed to overcome the resistance to latching suddenly encountered, each said latching projection rearward surface having a slope of between 70° and 90° associated with a steep rearward surface of an associated said latching section, to minimize resistance to resiling of a deflected said latching arm and latching of a said latching section therebehind, whereupon the latching section immediately rides over and latches behind the abrupt, steep latching projection.

11. An improved latching system as set forth in claim 10 wherein said one connector housing has two opposing said latching arms and said other connector housing has two opposing said latching projections.

* * * * *